US006080036A

United States Patent [19]

Adler

[11] Patent Number: 6,080,036

[45] Date of Patent: Jun. 27, 2000

[54] YO-YO HAVING RADIALLY ANCHORED CUSHIONS

[76] Inventor: Alan J. Adler, 752 La Para Ave., Palo Alto, Calif. 94306

[21] Appl. No.: 09/244,186

[22] Filed: Feb. 4, 1999

[51] Int. Cl.[7] ..... A63H 1/30

[52] U.S. Cl. ..... 446/250

[58] Field of Search ..... 446/247, 248, 446/250, 251

[56] References Cited

U.S. PATENT DOCUMENTS

| | | | |
|---|---|---|---|
| 207,527 | 8/1878 | Katz | 446/250 |
| 271,278 | 1/1883 | Schoenfeld | 446/250 |
| 2,809,833 | 10/1957 | Slade | 446/250 X |
| 3,081,578 | 3/1963 | Mosher | 446/251 |
| 3,175,326 | 3/1965 | Isaacson | 446/250 |
| 3,444,644 | 5/1969 | Sayegh | 446/250 |
| 3,953,936 | 5/1976 | Ennis | 446/250 |
| 4,130,962 | 12/1978 | Ennis | 446/250 |
| 4,867,727 | 9/1989 | Lanius | 446/250 X |
| 5,813,897 | 9/1998 | Van Dan Elzen et al. | 446/250 |
| 5,984,759 | 11/1999 | O'Sullivan | 446/250 |

*Primary Examiner*—John A. Ricci

*Attorney, Agent, or Firm*—Townsend and Townsend and Crew LLP

[57] ABSTRACT

A yo-yo comprising right and left bodies surrounded by thick, radially anchored, soft rubber outer cushions has a string gap having a contour that includes an innermost gap which is narrower than other regions of the string gap. The string gap may have a narrowed neck region located between the innermost gap and the outer diameter of the yo-yo. The yo-yo may include an axle which is permitted to rotate within the left body of the yo-yo but retained by a locknut seated in the right body of the yo-yo.

9 Claims, 7 Drawing Sheets

YO-YO HAVING RADIALLY ANCHORED CUSHIONS

BACKGROUND OF THE INVENTION

The present invention relates generally to toys, and more specifically to yo-yo's.

Cushions

Most yo-yo bodies are hard and can cause hand pain or injury when they return rapidly. They can also injure noses, furniture, walls and other things that they collide with. There have been a few prior yo-yo's with some attempt at cushioning.

U.S. Pat. No. 3,081,578 (Mosher) is typical of the prior cushion art. Mosher's specification discloses "annular bands." There are several yo-yo's on the current market also offering similar annular rubber bands. However, it appears that these yo-yo's do not provide a sufficient degree of cushioning.

a. The radial thickness of these bands is less than 0.2 inches. Mosher does not give dimensions. However, scaling from Mosher's figures reveals a radial thickness for his annular band 100 of approximately 0.025 inches.

b. The bands are not radially anchored to the body. Rather, they are retained by the elastic tension of the band itself. In order keep the band from flying off due to centrifugal force, these bands are made from a much stiffer rubber than optimum. They are typically made of a material having Shore durometer exceeding 65A.

The present inventor has evaluated yo-yo's having stiff, radially thin rubber bands and has found them to be useless for cushioning the impact of the yo-yo in the hand. In most cases, manufacturers of these yo-yo's do not claim cushioning. Instead, they state that the rubber bands protect the yo-yo bodies from abrasion on floors and other hard surfaces.

The Henry's yo-yo has bodies made almost entirely from rubber, with the rubber portions being mounted on small metal hubs). These bodies are hollow bell-shaped semi-spherical shells similar to those found on "Diavlo" toys. The unsupported nature of these rubber shells necessitates that they be made from stiff rubber which detracts from their cushioning benefit.

String Gaps

There are several prior configurations of gap geometry:

a. The most common configuration is a gap with parallel walls which are typically 0.08 to 0.13 inches apart. A disadvantage of this configuration is that narrow gap-entrance often drags on the string which shortens spin time and/or leads to tumbling due to gyroscopic precession.

b. An alternative gap configuration has all or a portion of the gap walls angled so as to increase the gap width at the gap-entrance. Examples of angled gap configurations can be found in U.S. Pat. Nos. 3,953,936, 4,130, 962 (both by Ennis) and U.S. Pat. No. 3,175,326 (Isaacson).

c. U.S. Pat. Nos. 207,527 (Katz) and 271,278 (Schoenfeld) disclose convex gap walls with spherical contours like the surface of a convex lens. This configuration also yields a widened gap-entrance.

d. There are also a number of "butterfly" yo-yo's on the market which have parallel gap walls but a large-radius mouth to widen the gap entrance.

Features to Facilitate Return

Most yo-yo's have short radial ribs to roughen the string-gap walls adjacent to the axle. The ribs catch the string when the user jerks the string to make the yo-yo wind thus return. When the yo-yo sleeps (spinning at the end of the string) the ribs rub the string, making noise and reducing spin time and string life.

Spintastics Corporation has manufactured yo-yo's which have a step in each gap wall adjacent to the axle. These steps have a radial dimension extending 0.115 inches outward from the axle or bearing.

Axle Types

Yo-yo's are made with either fixed axles or with rotating bearings, called transaxles. The string is wound in the gap either directly around the fixed axle, or around a transaxle bearing which surrounds the axle. Transaxle bearings are either sleeve journal) bearings or ball bearings. Transaxle yo-yo's sleep (spin) longer than fixed axle yo-yo's but are generally inferior for looping tricks. The string gap design is more critical for transaxle yo-yo's than for fixed axle yo-yo's because there is greater dependency on the string's grabbing the gap walls to facilitate return.

Advanced transaxle yo-yo users apply viscous grease adjacent to the bearing to create some drag in order to retard sleep and facilitate return during looping. They add more grease and change the string every ten to fifteen minutes of play. The grease makes it difficult to properly execute most non-looping tricks.

Assembly Method

The simplest yo-yo's comprise fixed assemblies with the axle rigidly fixed to the body elements. More advanced yo-yo's are screwed together to permit disassembly in order to remedy string tangles. Virtually all yo-yos of this category use the following method of assembly. The axle is threaded at both ends. Each end screws into a nut set in a mating socket in the body. The body elements are then rotated relative to each other to screw them on to the threaded ends of the axle. The torque that can be developed, even by a child, when rotating the body elements is high enough to shear off the threaded end of the axle. An added problem is that the body elements often unscrew in normal use. When this happens the yo-yo suddenly comes apart in mid-trick and parts scatter over a wide area. Often some of the parts become lost.

Gap Width and Adjustability

The majority of commercial yo-yo's have fixed width gaps. However, as mentioned above, transaxle yo-yo's are generally inferior for looping tricks. In an effort to correct this problem some transaxle yo-yo's have been offered with adjustable width gaps.

An early method of adjustment required the user to disassemble the yo-yo and insert or remove spacer washers. Some later yo-yo designs have offered the more convenient method of varying the gap by rotating the left and right body elements relative to each other. Rotation screws the body elements closer or farther apart. However, inadvertent rotation (if the yo-yo collides with an object) can still cause the yo-yo to disassemble or change gap setting during use.

SUMMARY OF THE INVENTION

The present invention provides a yo-yo that is easier, more comfortable, and safer to use. The yo-yo has a geometry which funnels the string for tricks, tolerates tilt without rubbing on the gap entrance, has exceptionally long sleep time, and permits a single gap width setting to both loop well and sleep well. The yo-yo can be disassembled to remedy string tangles, yet will not come apart in use and cannot be overtorqued during assembly. The gap is instantly adjustable (without disassembly) yet the gap setting will not change during use or collisions.

A yo-yo according to the invention includes first and second bodies (sometimes referred to as left and right bodies) joined by an axle with a string gap therebetween. According to one aspect of the invention, the bodies are surrounded by thick, radially anchored soft rubber cushions which greatly enhance user comfort and safety.

According to another aspect of the invention, the string gap has a contour that includes an innermost gap which is narrower than other regions of the string gap. This permits a single gap width setting to both loop well and sleep well. In a specific embodiment, the innermost gap has a radial dimension of less than 0.075 inches.

According to another aspect of the invention, the string-gap has a an annular region (neck) wherein the string-gap is narrower than other regions of the string-gap except the innermost gap, with the neck being located between the innermost gap and the outer diameter of the yo-yo. The string gap may be roughened, to facilitate return, in an annular region located between the innermost gap and the neck.

According to another aspect of the invention, the first and second bodies are joined by an axle comprising a screw which passes through both bodies. The screw is permitted to rotate within the first body, and a locknut is threaded on the end of the screw. The locknut is seated in a mating socket in the second body and thus rotationally locked to the second body. Springs push the bodies axially away from the string gap, such that when the screw is loosened the string gap becomes wider and conversely when the screw is tightened the string gap becomes narrower. If the bodies rotate relative to each other, there is no change in the width of the string gap because the screw does not rotate in the locknut but is permitted to rotate within the first body.

According to yet another aspect of the invention, the yo-yo comprises first and second bodies joined by an axle, with a string-gap between the bodies, wherein the string gap widens as it progresses radially outward from the axle substantially according to the equation gap= constant*radius^n, where n is greater than 2.

A further understanding of the nature and advantages of the present invention may be realized by reference to the remaining portions of the specification and the drawings.

DESCRIPTION OF THE SPECIFIC EMBODIMENTS

Figure 1:
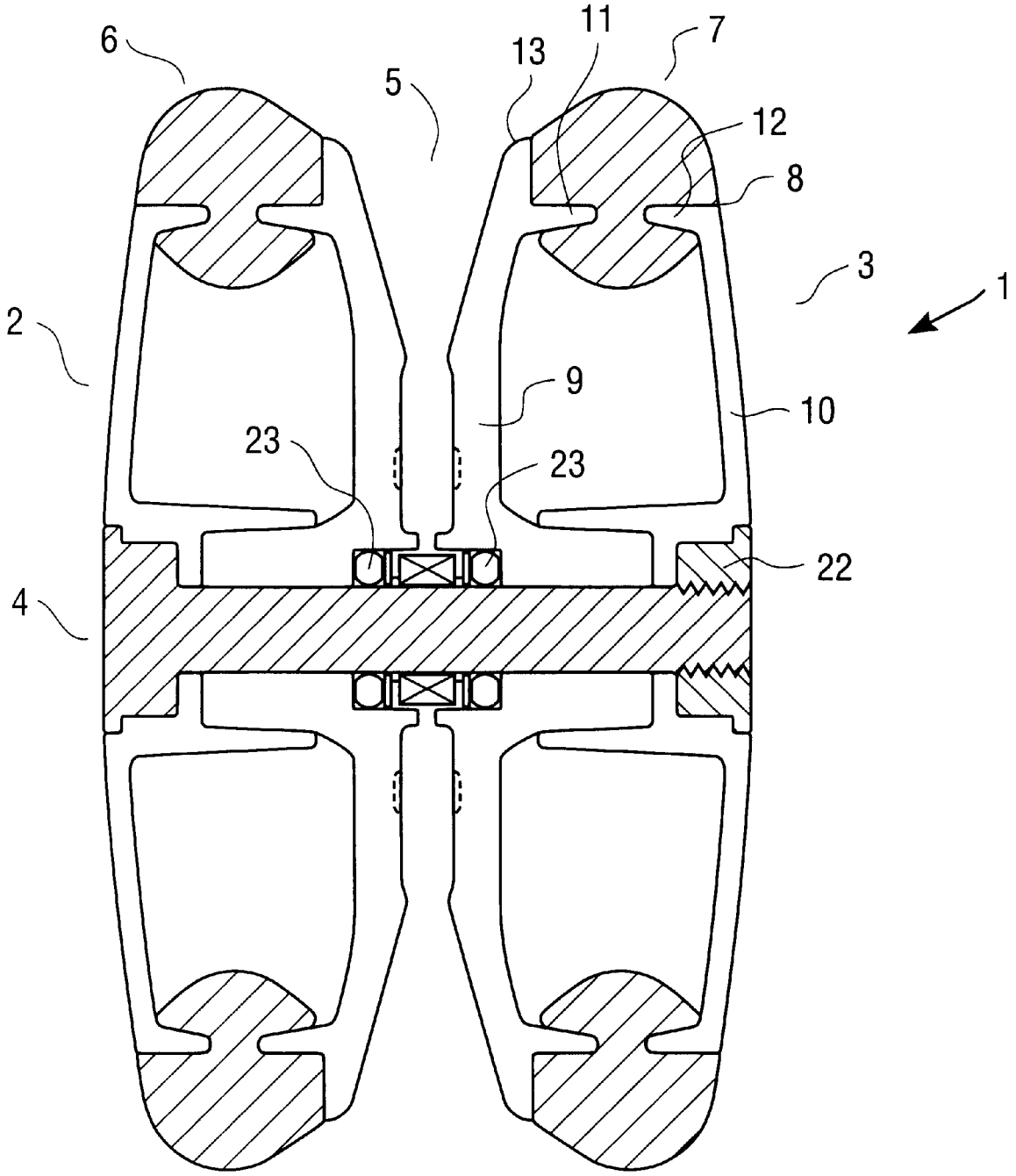
FIG. 1 is a cross-section of the preferred embodiment.

Referring to FIG. 1, the invention is a yo-yo 1 comprising left and right bodies 2 and 3 joined by an axle 4, a string-gap 5 between the bodies, and left and right elastomer 6 and 7 cushions radially anchored to the respective outer perimeters 8 of the left and right bodies. Although the invention does not depend on particular dimensions, it is noted that yo-yo's are typically 2.0–2.5 inches in diameter, and the particular embodiment has a diameter of 2.3 inches.

For general use, it is preferred that the elastomer cushions are of a durometer softer than Shore 65A. However for some special tricks harder durometer may be preferred. Furthermore, in order to give adequate cushioning, it is desirable that the elastomer cushions have a radial thickness of 0.2 inches or more.

The inventor discovered that radial anchors are essential to retain the cushions on the bodies to counter the centrifugal force encountered in use. Several methods of anchoring are disclosed below.

Continuing with FIG. 1, note that each of the bodies comprises an inner and an outer component 9 and 10, each component having a flange 11 and 12 which protrudes into a respective groove on the respective inner and outer sides of said cushion in order to radially anchor the cushion to the body.

Figure 4:
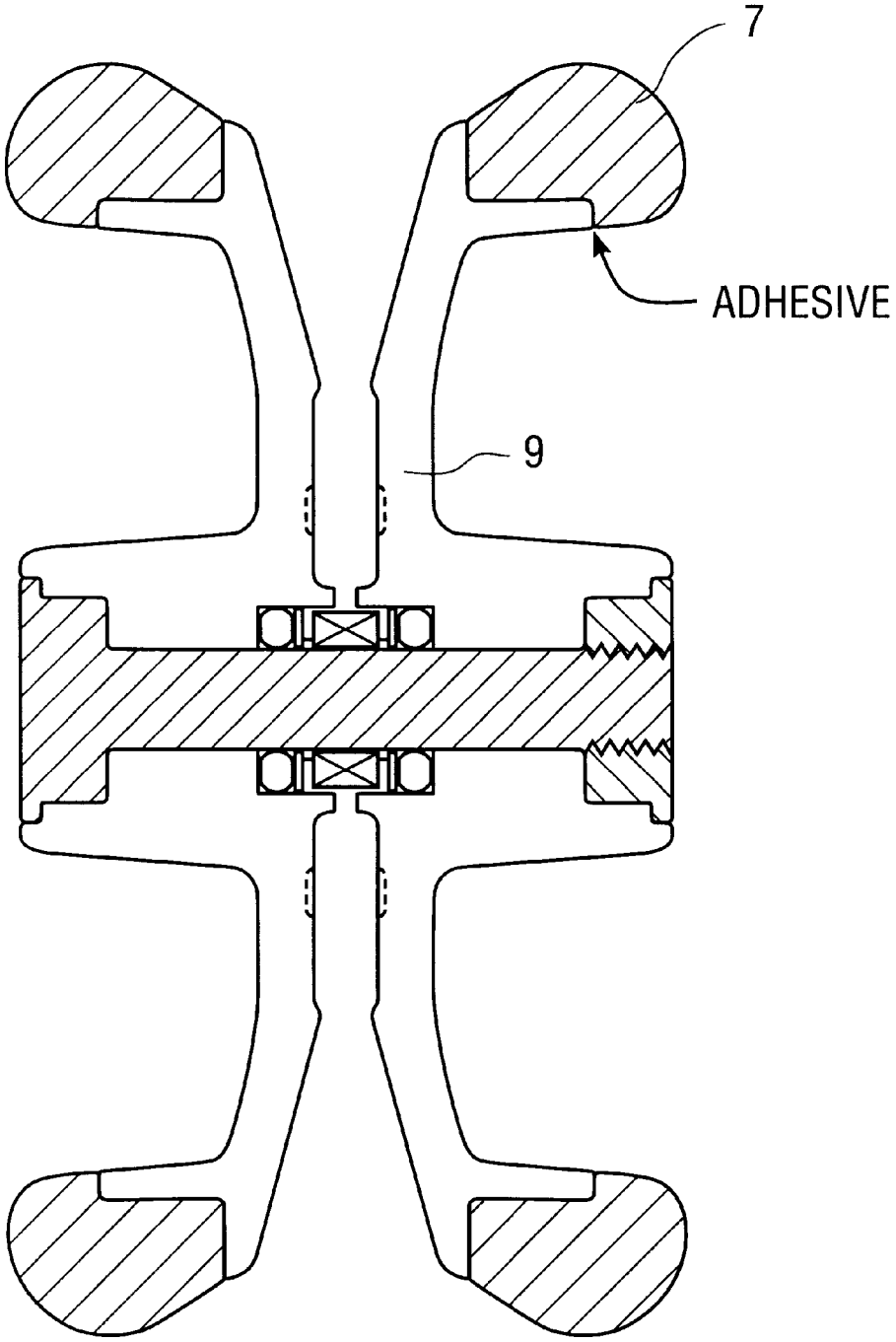
FIG. 4 is a cross-section of an alternative embodiment in which the cushions are adhesively bonded to the bodies.

FIG. 4 is a cross-section of an alternative embodiment in which the cushions are adhesively bonded to the bodies. This figure illustrates a yo-yo with open sides, but side covers could be included with this embodiment.

Figure 5:
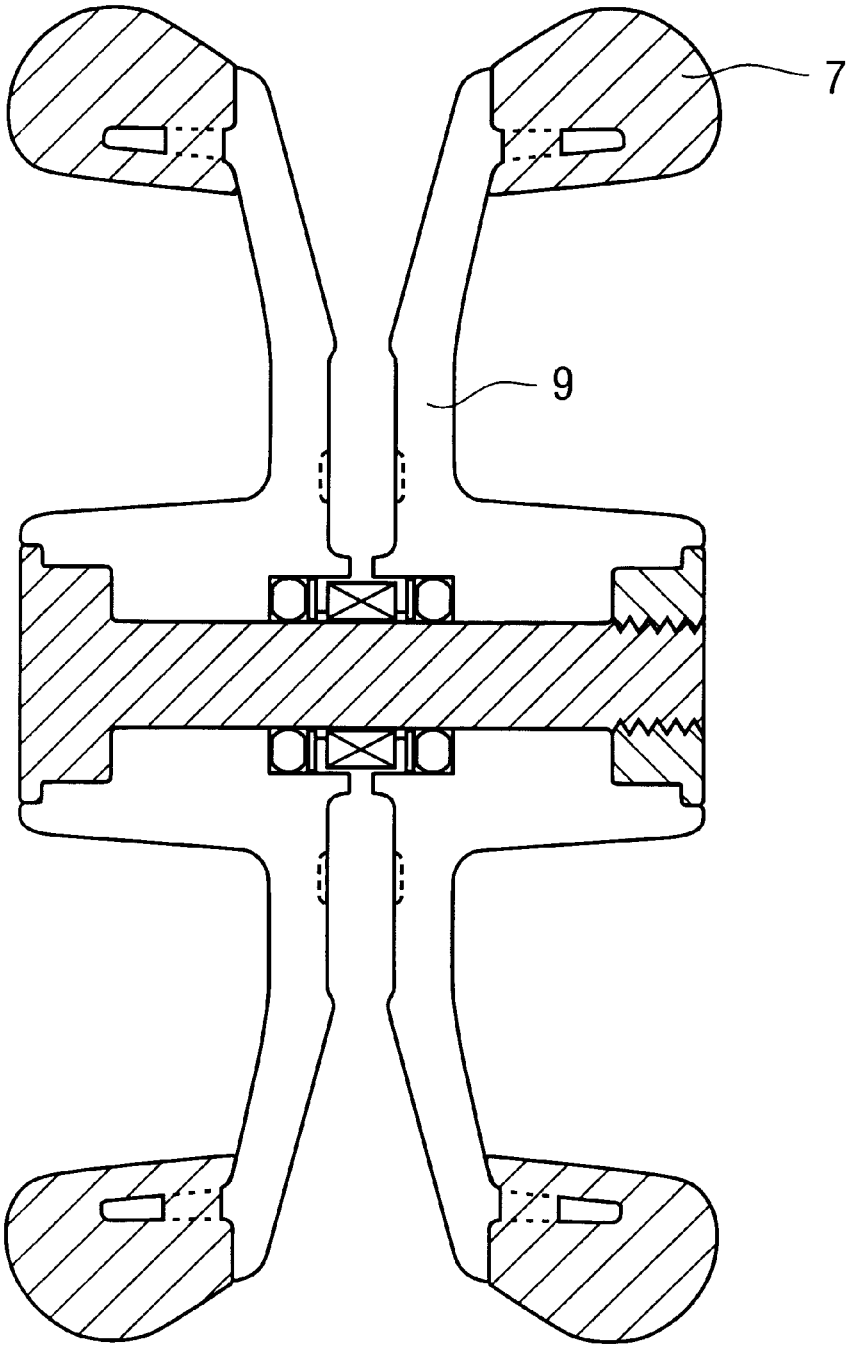
FIG. 5 is a cross-section of an alternative embodiment in which the cushions are molded over the bodies.

FIG. 5 is a cross-section of an alternative embodiment in which the cushions are molded over the bodies to radially anchor the cushions to the bodies. In this case, the body is inserted into a mold and overmolded with the elastomer cushion. With some combinations of body and cushion material, a bond will naturally occur between the materials during the overmolding process. With other combinations of materials, the body must have holes or other devices for the elastomer to flow through (or around) to lock the cushion to the body as shown in this figure. Once again, this figure illustrates a yo-yo with open sides, but side covers could be included in this embodiment.

Figure 3:
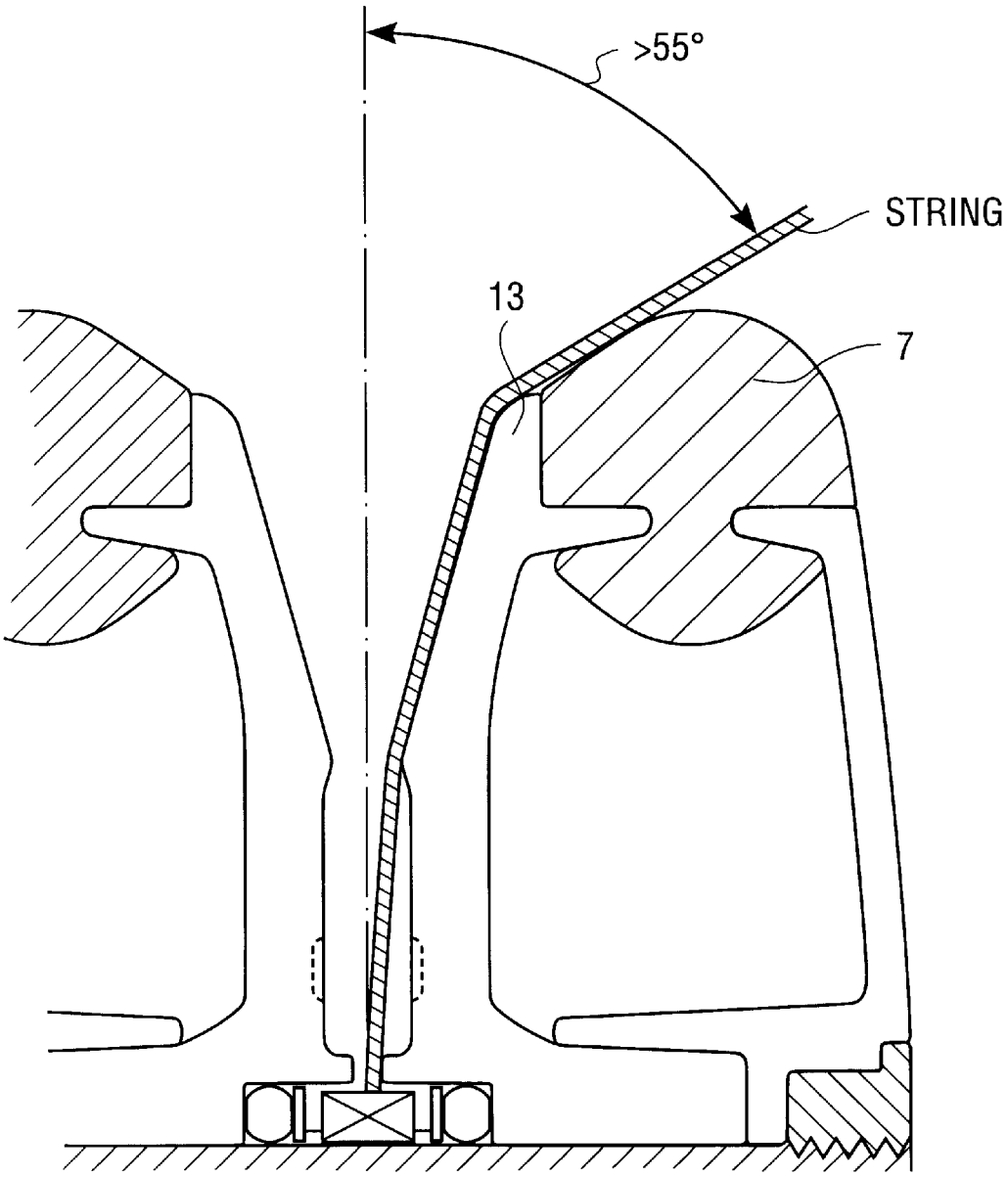
FIG. 3 is a cross-section detailing the geometrical configuration to prevent the string from contacting the elastomer cushions.

Referring to FIG. 3, note that the bodies extend radially 13 at the outer perimeter of their string-gap surfaces so as to deflect the string from contacting the elastomer cushions. In the preferred embodiment, the radially extended bodies 13 and elastomer cushions 7 are geometrically configured such that the string will not contact the elastomer cushions for any angle of lateral string deflection between plus and minus 55 degrees.

Figure 2:
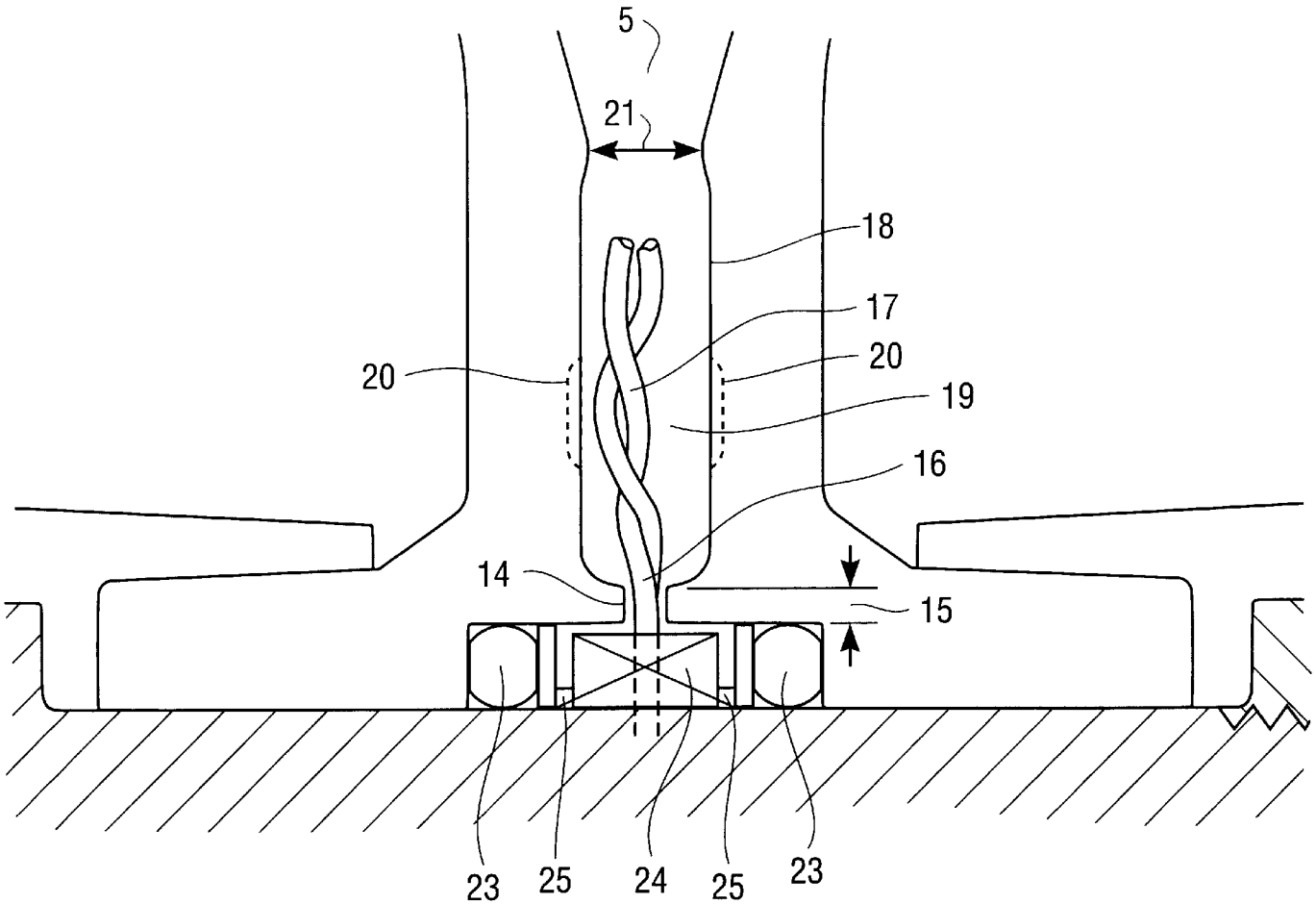
FIG. 2 is an enlarged view of FIG. 1, detailing the inner portion of the string-gap.

An important feature of the invention is detailed in FIG. 2. Note that in the string-gap between the bodies there is an innermost gap 14 which is axially narrower than other regions of the string-gap. It is preferred that this innermost gap 14 have a radial dimension 15 of less than 0.075 inches. In use, the left and right surfaces of innermost gap 14 drag slightly on the single-strand loop 16 of the string. Yet in the string-gap region 19 outside of innermost gap 14 the gap is wider, insuring that the twisted portion of the string remain free of the sidewalls 18 except while the string is winding.

In a representative embodiment, the innermost gap has a radial dimension of 0.035 inches and an axial width of 0.040 inches. By way of background, each of the twisted pair of strands on a typical yo-yo string has a diameter on the order of 0.018 inches.

This feature of the invention permits a single string-gap setting to both loop well and sleep well. It also eliminates the necessity to add viscous grease to the bearing region as is commonly done with prior art transaxle yo-yos.

Continuing with FIG. 2, note that the string gap has a neck 21 comprising an annular region wherein the string-gap is narrower than other regions of the string-gap except the innermost gap. The neck is located between the innermost gap 14 and the outer diameter of the yo-yo. The neck improves the control of the yo-yo during looping.

FIG. 2 also shows that the string gap is roughened 20, to facilitate return, in an annular region located between the innermost gap 14 and the neck 21. This roughened area improves the tightness of the wind and is desirable with new strings and/or when the yo-yo returns from a slow spin state. The roughened area may comprise a pattern of shallow radial grooves, shallow radial ribs or a textured region. Note that the string does not contact the roughened region while the yo-yo is sleeping.

In FIG. 1 note that the left and right bodies 2 and 3 are joined by an axle 4 comprising a screw which passes through both bodies. The screw is permitted to rotate within the left body 2. A locknut 22 is threaded on the end of the screw. The locknut is seated in a mating socket in the right body 3, 10 and thus rotationally locked to the right body.

According to one aspect of the invention, the yo-yo includes springs 23 pushing the bodies axially away from the string gap, such that when the screw 4 is loosened the string gap becomes wider and conversely when the screw is tightened the string gap becomes narrower. In the preferred embodiment, springs 23 comprise rubber O-rings.

If the left and right bodies rotate relative to each other there is no change in the width of the string gap because the screw 4 does not rotate in the locknut but is permitted to rotate within the left body 2.

Figure 6:
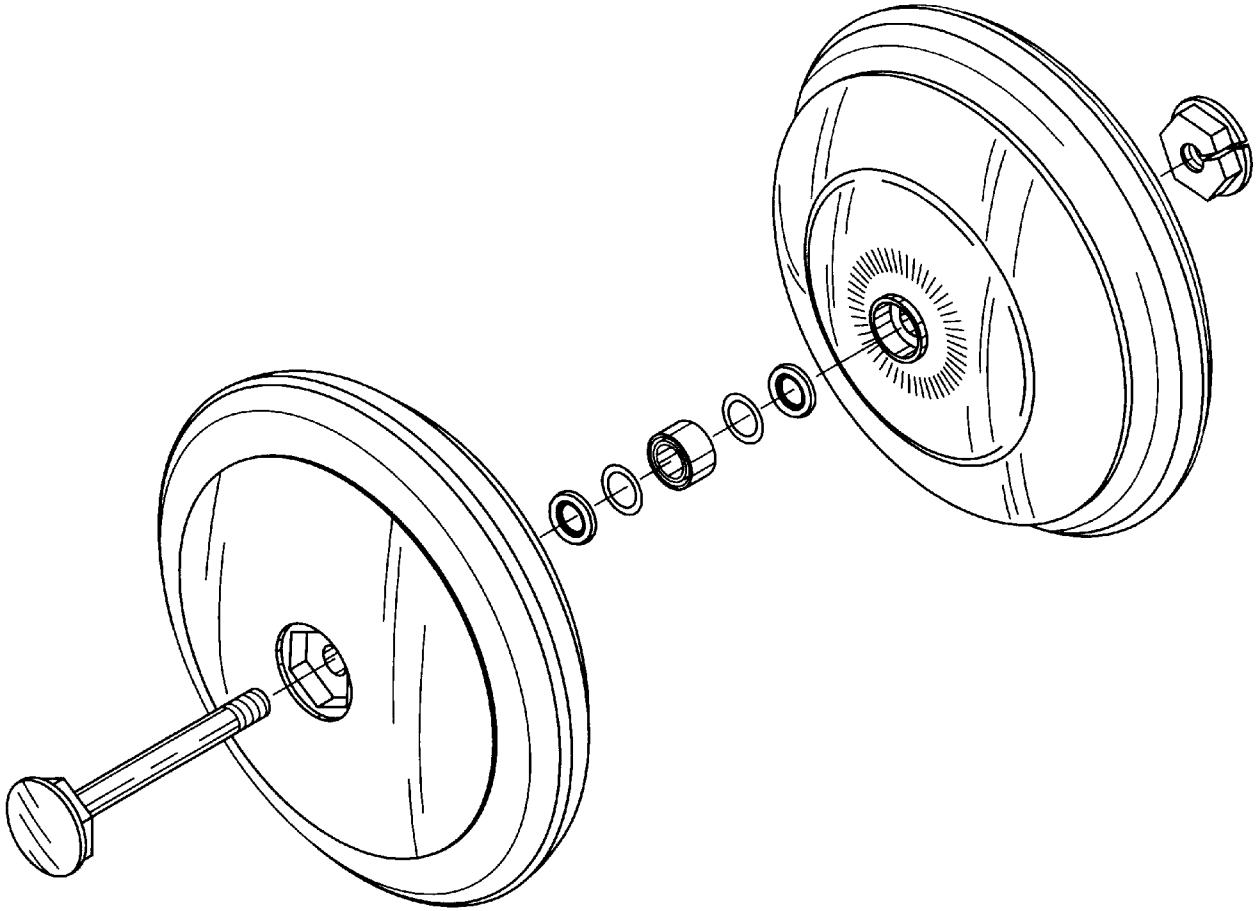
FIG. 6 is an exploded perspective of an alternative embodiment in which the gap width may be adjusted by rotating the bodies relative to one another.

FIG. 6 shows an alternative where the screw may have a non-round head, such as a hex or square. In this alternative, the screw head is seated into a mating socket in left body 2 and thus is rotationally locked to that body. This permits gap width adjustment by rotating the left and right bodies relative to each other, as previously discussed in the background section. This alternative offers slightly more convenient gap width adjustment in exchange for slightly greater susceptibility to inadvertent changes in the gap width setting.

Note in FIG. 2 that the yo-yo has a bearing 24 on the axle, positioned at the string gap. The bearing is free to rotate on the axle with springs 23 pressing on the ends of the fixed inner race 25 of the bearing.

Figure 7:
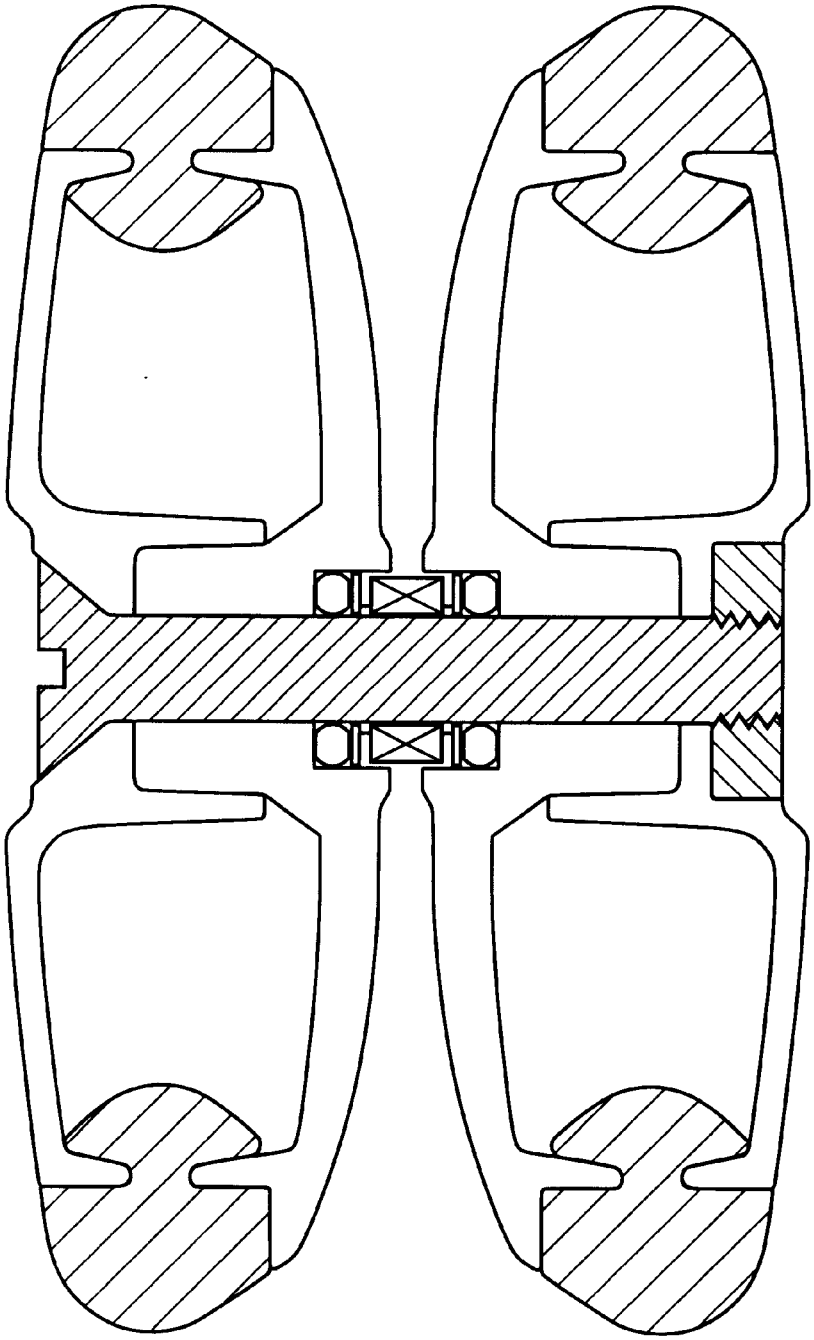
FIG. 7 is a cross-section of an alternative embodiment in which the string gap widens as it progresses radially outward from the axle according to an equation.

FIG. 7 is a cross-section of an alternative embodiment in which the string gap widens as it progresses radially outward from the axle according to the equation gap= constant*radius^n, where n is greater than 2. The inventor has found that a yo-yo having a gap thusly configured where n=3 (cubic equation) has exceptionally smooth operation for general play. This configuration provides superior looping performance to prior art yo-yo string-gaps having spherical inner faces.

While the above is a complete description of specific embodiments of the invention, various modifications, alternative constructions, and equivalents may be used. Therefore, the above description should not be taken as limiting the scope of the invention as defined by the claims.

What is claimed is:

1. A yo-yo comprising left and right bodies joined by an axle, a string-gap between the bodies, and left and right elastomer cushions radially anchored to the respective outer perimeters of the left and right bodies.

2. The yo-yo of claim 1 wherein the elastomer cushions are of a durometer softer than Shore 65A.

3. The yo-yo of claim 1 wherein the elastomer cushions have a radial thickness of 0.2 inches or more.

4. The yo-yo of claim 1 wherein the elastomer cushions are of such soft durometer that radial anchors are essential to retain the cushions on the bodies to counter the centrifugal force encountered in use.

5. The yo-yo of claim 1 wherein each of the bodies comprises an inner and an outer component, each component having a flange which protrudes into a respective groove on the respective inner and outer sides of said cushion in order to radially anchor the cushion to the body.

6. The yo-yo of claim 1 wherein the cushions are molded over said bodies to radially anchor the cushions to the bodies.

7. The yo-yo of claim 1 wherein the cushions are adhesively bonded to the bodies.

8. The yo-yo of claim 1 wherein the bodies extend radially at the outer perimeter of their string-gap surfaces so as to deflect the string from contacting the elastomer cushions.

9. The yo-yo of claim 8 wherein the radially extended bodies and elastomer cushions are geometrically configured such that the string will not contact the elastomer cushions for any angle of lateral string deflection between plus and minus 55 degrees.

* * * * *